United States Patent [19]

Frechet

[11] Patent Number: 4,580,693

[45] Date of Patent: Apr. 8, 1986

[54] CLOSURE DEVICE OR SCREEN FOR A REFRIGERATOR CASE

[75] Inventor: Olivier Frechet, Ciboure, France

[73] Assignee: Etablissements Bonnet, Villefranche-sur-Saone, France

[21] Appl. No.: 565,813

[22] Filed: Dec. 27, 1983

[30] Foreign Application Priority Data

Dec. 30, 1982 [FR] France ..... 82 22085

[51] Int. Cl.[4] ..... B65D 55/00

[52] U.S. Cl. ..... 220/240; 312/284

[58] Field of Search ..... 312/214, 284; 160/354; 220/240, 305

[56] References Cited

U.S. PATENT DOCUMENTS 2,518,764 8/1950 Dunlap ..... 312/312

3,064,725 11/1962 Roark ..... 160/354

FOREIGN PATENT DOCUMENTS 2335808 7/1977 France .

2092730 3/1981 United Kingdom .

*Primary Examiner*—Francis K. Zugel

*Assistant Examiner*—Joseph Falk

*Attorney, Agent, or Firm*—Oblon, Fisher, Spivak, McClelland & Maier

[57] ABSTRACT

A closure device consisting of a screen for a refrigerator case such as an open-top chest or a display case. In its closed position, the device performs the function of a heat-insulating barrier against reheating by convection. In its open position, the device performs the function of a shield against reheating by radiation. The screen structure can be inflated with air or with a fluid having lower density than air. The device can thus be displaced with great ease and can be maintained in its open shielding position by a maximum number of two lightweight supports.

12 Claims, 5 Drawing Figures

FIG. 1
PRIOR ART
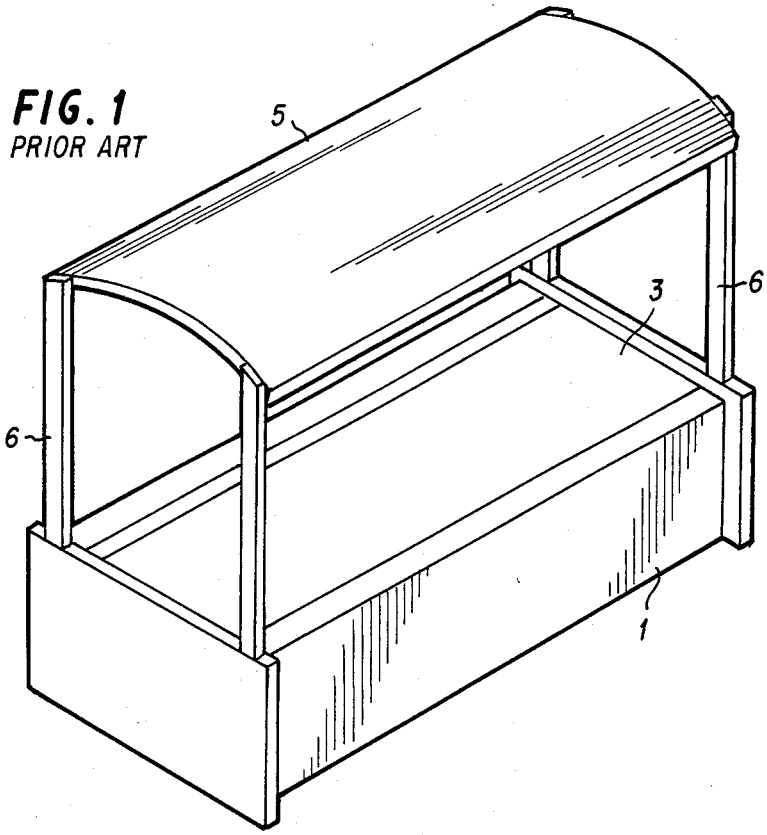
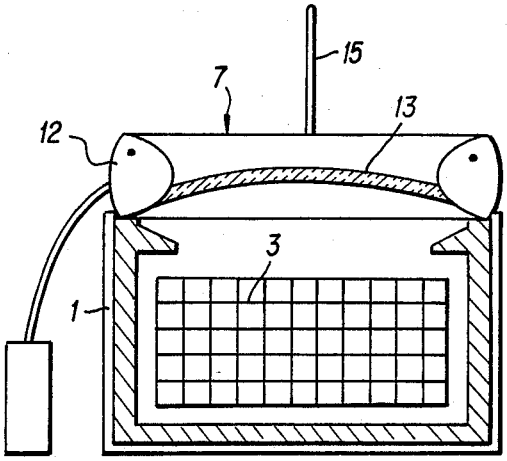
FIG. 2

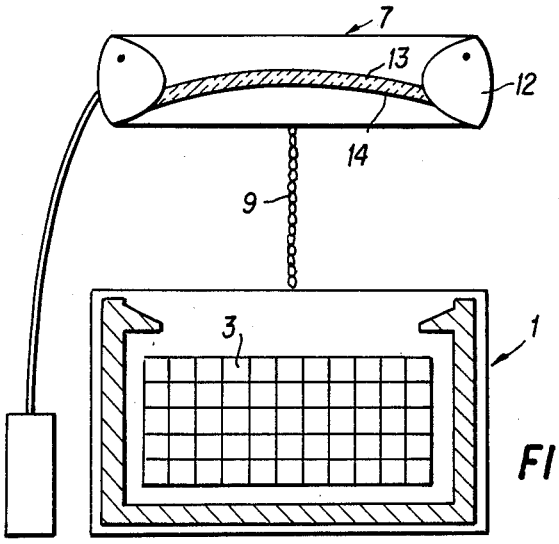
FIG. 3
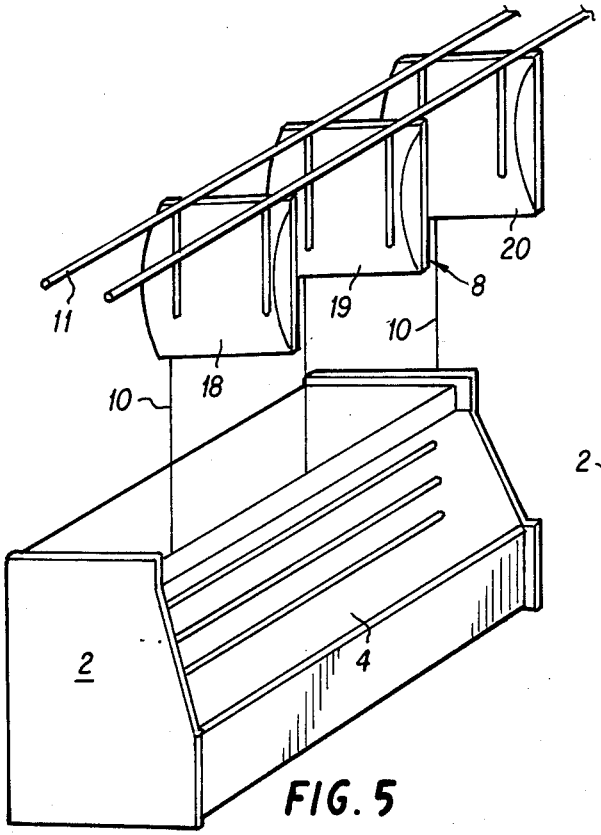
FIG. 5
FIG. 4
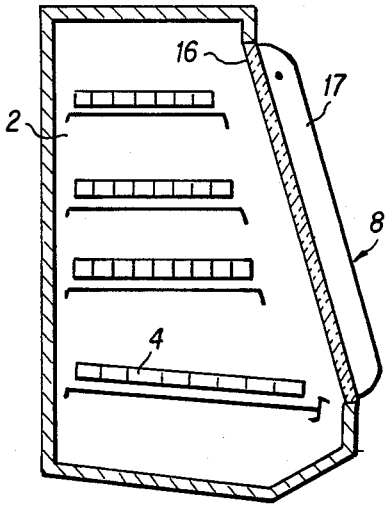

CLOSURE DEVICE OR SCREEN FOR A REFRIGERATOR CASE

BACKGROUND OF THE INVENTION

1. Field of the Invention

The present invention relates to a removable closure device for a refrigerator case as well as a fixed or removable screen or canopy for a case of this type.

2. Description of the Prior Art

A refrigerator case or cabinet, especially of the type used for display or sale of food products, such as a chest or display case, is usually of the open type or in other words has an opening which is not separated from the external atmosphere by a material barrier. In a refrigerator case of this type, food products are directly subjected to reheating by radiation of the environmental atmosphere and to reheating by convection of the external atmospheric air. This results in high power consumption in order to produce the cold which is necessary in order to maintain these food products at the temperature prescribed by regulations.

In order to reduce this cold consumption, removable or fixed devices in the form of a cover, canopy or curtain for closing refrigerator cases have already been proposed. These known devices fall into two classes: on the one hand the removable devices which close the opening of a refrigerator case outside selling periods and on the other hand the fixed devices which form a screen against heat radiation and are placed at a distance from the opening opposite to the food products to be preserved. These devices perform the function of a barrier against the heating action of the external atmosphere by convection and/or by radiation. During the period of selling of products, the known devices of the first class are removed, stored or arranged at a predetermined height above said refrigerator case whilst the devices of the second class remain permanently fixed in position.

Known devices in the form of a cover or canopy are usually heavy, cumbersome and costly. Whenever it is necessary to open or close the refrigerator case, considerable time and labor are involved in the handling of these known devices which also require substantial storage space.

One known device in the form of a canopy is usually maintained at a predetermined height above the opening of the refrigerator case in order to protect the latter against heating by radiation but this canopy calls for strong supports which impair the convenience of access to the refrigerator case.

Known devices in the form of a curtain entail the need for an enclosed space for storing them within the refrigerator cases which they are designed to protect. A further point is that the structure of these curtain-type devices is such that cases or cabinets protected by them are not provided with an effective insulating barrier against the external atmosphere.

SUMMARY OF THE INVENTION

The object of the present invention is to overcome the foregoing disadvantages by means of a closure device for an open-type refrigerator case, especially of the chest type or display case type. Said closure device is either fixed or removable, can be produced at low cost, is of lightweight construction, ensures heat insulation and protection against heat transfer by convection and by radiation produced by the external atmosphere.

A removable lightweight or "floating" device is relatively easier to move than a device which has an equivalent bulk but greater weight.

A lightweight device of this type permits the use of light and simple means for maintaining it in position during closing or opening of the refrigerator case which is protected by the device.

In accordance with the invention, a refrigerator-case closure device consisting of a screen which performs in its closed position the function of a heat-insulating barrier against reheating by convection and which performs in its open position the function of a shield against reheating by radiation is primarily distinguished by the fact that said closure device comprises an inflatable structure which permits displacement and handling with great ease and makes it possible by means of a maximum two lightweight supports to maintain the device in its screen position for shielding against reheating by radiation.

Various other objects, features and attendant advantages of the present invention will be more fully appreciated as the same becomes better understood from the following detailed description when considered in connection with the accompanying drawings in which like reference characters designate like or corresponding parts throughout the several views and wherein:

BRIEF DESCRIPTION OF THE DRAWINGS

FIG. 1 is a schematic view of an open-type refrigerator case of the chest type in which provision is made for a known screen device in the form of a canopy.

FIG. 2 is a schematic transverse sectional view of a chest-type refrigerator case closed by a device constructed in accordance with the invention.

FIG. 3 is a schematic view of the refrigerator case of FIG. 2 in the open position with its canopy screen device placed in position at a predetermined height above said refrigerator case.

FIG. 4 is a schematic sectional view of a display-case refrigeration unit closed by a device constructed in accordance with the invention.

FIG. 5 is a schematic view of a display-case refrigeration unit of FIG. 3 in the open position, and of the elements of its closure device placed in position above the display case.

DETAILED DESCRIPTION OF THE PREFERRED EMBODIMENT

A refrigerator case of the type consisting of a chest 1 as shown in FIGS. 1, 2 and 3 or of the type consisting of a display case 2 shown in FIGS. 4 and 5 is intended to display food products 3 and 4 for sale.

The refrigerator cases 1 and 2 are of the open type. The food products 3 and 4 which are stored therein are exposed to reheating by convection of the environmental air and by radiation of the external atmosphere which surrounds said refrigerator cases.

In order to reduce the cold consumption which is necessary for maintaining these food products at the temperature laid down by regulations, a known solution consists in providing the refrigerator case 1 with a known screen device 5 in the form of a canopy. When the food products 3 are displayed during the selling hours, the device 5 is maintained at a predetermined height above the refrigerator case 1 by means of supports 6.

At this height, the device 5 constitutes an effective barrier against a large proportion of radiation of the external atmosphere in order to reduce reheating of the food products 3 but cannot prevent reheating by convection of the ambient air. When the products 3 are no longer displayed, that is to say during non-selling hours, the device 5 is placed in position on the opening of the refrigerator case 1 in order to close this latter and consequently in order to prevent both reheating by radiation and reheating by convection of the external atmosphere. An appreciable economy of refrigerating power is thus obtained and may in some cases attain 30% of this refrigerating power.

In order to achieve a maximum saving of refrigerating power, the known closure device 5 is constructed with a substantial thickness of insulating material and has a rigid and more or less massive structure in order that it may thus be capable of withstanding the frequent operations which involve opening and closing of the refrigerator case 1 as well as handling. In consequence, the known closure device 5 is of relatively substantial weight. This in turn results in laborious and difficult handling of the device. Furthermore, the upright members 6 which support the device must have sufficient mechanical strength to carry its weight and are usually of massive design. Upright members or supports 6 of this type prevent freedom of access to the refrigerator case 1 and have a general appearance which is often unattractive. When the supports 6 are dispensed with, the device 5 in that case constitutes a simple cover and must be stored within a space which is specially provided for this purpose. Since the device is intended to cover the entire opening of the refrigerator case 1, the device 5 has practically the same dimensions as this latter. Such dimensions call for a relatively large space for storage of the device 5.

Closure devices 5 of known types are thus attended by disadvantages which are far from negligible.

A closure device 7 or 8 constructed in accordance with the invention and illustrated diagrammatically by way of example in FIGS. 2, 3, 4 and 5 makes it possible to avoid or effectively to reduce these drawbacks.

In accordance with the invention, the closure or screen device 7 or 8 is a device having an inflatable structure which performs in its closed position the function of a heat-insulating barrier against reheating by convection and which performs in its open position the function of a shield against reheating by radiation.

An inflatable device of this type is of low weight in comparison with known closure devices 5, with the result that handling of the device is easier. Moreover, deflation of this device can produce a substantial reduction in overall size, thus further facilitating the handling operation.

In accordance with the invention, the closure device 7 or 8 can be inflated with air or a fluid which has lower density or is lighter than air. When the device 7 or 8 is inflated with a fluid having lower density than air, it is reduced in weight even further and is in that case much easier to handle than a known closure device 5. When the inflating fluid makes the device 7 or 8 lighter than air, the result thereby achieved is a "floating" or buoyant device. The device 7 or 8 can then be maintaned in its radiation-shielding or screen position at a predetermined height above the refrigerator case 1 by means of one or two lightweight supports or flexible cords of small thickness such as the cords 9 and 10. The disadvantages of massive and rigid supports 6 are thus removed. A further result is that the device 7 or 8 can be stored against the ceiling or in the space above the refrigerator case 1. This makes it possible to circumvent the disadvantages which arise from the need to provide a large space specially reserved for storage of closure devices 5 of known types.

In order to avoid inopportune displacement of the closure devices 7 or 8 stored above the refrigerator case 1 (as shown in FIG. 5), a rack 11 for the storage of said devices 7 or 8 and constituted by compartments of openwork structure is mounted against the ceiling or in the space above said refrigerator case 1.

In one example illustrated in FIG. 2, the device 7 for closure of the chest-type refrigerator case 1 is provided around its periphery with an inflatable tube 12 and is provided in its central zone with a body 13 having a small thickness with respect to its area and filled with heat-insulating material. The peripheral edge of the closure device 7 as defined by the inflatable tube 12 is adapted to correspond in shape to the opening of the refrigerator case 1 and closes said opening when the device 7 is applied against this latter. The surface 14 of the body 13 in oppositely-facing relation to the refrigerator case 1 is preferably endowed with a low degree of natural thermal emissivity, such as a reflecting surface.

The body 13 can also be constituted by an inflatable body. In this case, the device 7 is inflatable over its entire area. The inflatable tube 12 and the inflatable body 13 are preferably divided into cells which communicate with each other only through small passages for the inflating fluids. When the tube 12 and/or the body 13 are filled with air or with inflating fluid, another result is obtained in addition to the appreciable reduction in weight of the device 7 with respect to the known device 5 and this is due to the fact that the device 7 constitutes an excellent heat-insulating barrier for protecting the case 1. The inflating air or fluid which is compartmentalized and immobilized within the cells of the inflatable device 7 accordingly performs the function of an excellent heat insulator which replaces the known insulating materials.

When the device 7 is inflated with air or with a fluid which does not endow it with buoyancy, its weight remains relatively low in comparison with the weight of a known closure device 5. In order to maintain the device in its radiation shield position at a predetermined height above the chest unit 1, lightweight supports of small size such as, for example, two rigid rods 15 placed at the two opposite ends of said chest unit 1 prove wholly satisfactory in this case. The disadvantages of massive supports 6 are consequently avoided.

In another example which is illustrated schematically in FIGS. 4 and 5, the closure device 8 of the display case 2 is made up of two portions, namely a flat portion 16 located opposite to said display case 2 and filled with heat-insulating material, and an inflatable portion 17 directed towards the exterior of said display case 2 and filled with air or a fluid having lower density than air. The screen device 8 is placed in a position (not shown in the figures) in which it performs its function of a shield against reheating by radiation.

The flat portion 16 located opposite to the display case 2 can have a surface which is endowed with low emissivity such as a reflecting surface, for example.

The closure device 8 performs the same functions and provides the same advantages as those of the device 7 in comparison with the known device 5. In the device 8, the flat portion 16 can be an inflatable portion and the insulating material which fills this latter can be replaced by an inflating fluid.

In the case of a refrigertor case 1 or 2 of relatively substantial length, its closure or screen device 7 or 8 can be formed by a plurality of separately assembled elements, namely three separately assembled elements 18, 19, 20 in the example illustrated in FIG. 5.

The closure devices 7 and 8 constructed in accordance with the invention are of low weight, can readily be moved, transported and maintained in position. The closure devices can also be constructed in any desired shape or form, thus making it possible to integrate them with their surroundings and/or to constitute a support for advertizing purposes.

By virtue of their inflatable structure and their low weight, these devices 7, 8 also make it possible to achieve an appreciable saving of time and labor in both installation and operation of the refrigerator case 1 or 2.

The closure devices 7 or 8 can be inflated in situ or inflated and deflated at any desired moment. Reserves or sources of inflating fluid can be incorporated in the mass of the device, permanently connected to said devices 7 or 8, or made independent of these latter, in accordance with techniques which are already known.

The closure devices 7 or 8 are fabricated from synthetic material, rubber, treated fabrics or from any other flexible material which has high strength and is impervious to the inflating gaseous fluids employed.

What is claimed is:

1. A closure device for an open display refrigeratorcase consisting of a screen which performs in its closed position the function of a heat-insulating barrier against reheating by convection and which performs in its open position the function of a shield against radiation, wherein said closure device comprises:

a displaceable inflated, lighter than air sealing structure inflated with fluid lighter than air; and flexible means exclusively interconnecting said case and said inflatable structure for maintaining said inflated structure in a floating position located above the case.

2. A device according to claim 1, wherein said inflated structure further compises at its periphery an inflated tube and a body located in a central zone of said device which is filled with heat-insulating material.

3. A device according to claim 1, wherein said inflated structure further comprises first and second portions, wherein said first portion further comprises a peripheral inflated tube and said second portion further comprises an inflated body in a central zone of said device.

4. A device according to claim 1, wherein said inflated structure further comprises first and second portions, said first portion being essentially flat in oppositely-facing relation to the refrigerator case and which is filled with heat-insulating material, said second portion being inflated and directed away from said refrigerator case.

5. A device according to claim 1, wherein said inflated structure further comprises first and second inflated portions, said first portion being essentially flat, and said second portion being directed away from said refrigerator case.

6. A device according to claim 5, wherein said flexible means for maintaining said inflated structure further comprises first and second flexible cords.

7. A device according to claim 6, wherein said inflated structure further comprises first and second inflated portions divided into cells which communicate with each other by means of small passages for an inflating fluid.

8. A device according to claim 7, wherein said inflated structure includes a surface having low emissivity in a face portion located opposite to the refrigerator case.

9. A device according to claim 8, wherein said inflated structure further comprises a reflecting surface.

10. A device according to claim 9, wherein said inflated structure is connected mechanically to a reserve of inflating fluid.

11. A device according to claim 9, wherein said inflated structure further comprises a reserve of inflating fluid incorporated in said first and second inflated portions.

12. A device according to claim 11, wherein said inflated structure is formed of flexible, high-strength material impervious to the inflating fluid.

* * * * *